US011242602B2

(12) United States Patent
Neumann et al.

(10) Patent No.: US 11,242,602 B2
(45) Date of Patent: Feb. 8, 2022

(54) ELECTROCHEMICAL OXYGENATION OF HYDROCARBONS

(71) Applicant: YEDA RESEARCH AND DEVELOPMENT CO. LTD, Rehovot (IL)

(72) Inventors: Ronny Neumann, Kfar Saba (IL); Marco Bugnola, Rehovot (IL)

(73) Assignee: YEDA RESEARCH AND DEVELOPMENT CO. LTD, Rehovot (IL)

( * ) Notice: Subject to any disclaimer, the term of this patent is extended or adjusted under 35 U.S.C. 154(b) by 52 days.

(21) Appl. No.: 16/619,781

(22) PCT Filed: Jun. 6, 2018

(86) PCT No.: PCT/IL2018/050613
§ 371 (c)(1),
(2) Date: Dec. 5, 2019

(87) PCT Pub. No.: WO2018/225066
PCT Pub. Date: Dec. 13, 2018

(65) Prior Publication Data

US 2020/0123669 A1 Apr. 23, 2020

(30) Foreign Application Priority Data

Jun. 7, 2017 (IL) ..... 252758

(51) Int. Cl.
*C25B 3/23* (2021.01)
*C25B 9/17* (2021.01)
*C25B 11/075* (2021.01)

(52) U.S. Cl.
CPC ..... *C25B 3/23* (2021.01); *C25B 9/17* (2021.01); *C25B 11/075* (2021.01)

(58) Field of Classification Search
None
See application file for complete search history.

(56) References Cited

U.S. PATENT DOCUMENTS

| | | | | |
|---|---|---|---|---|
| 4,661,422 | A | 4/1987 | Marianowski et al. | |
| 2003/0181739 | A1 | 9/2003 | Neumann et al. | |
| 2016/0264412 | A1* | 9/2016 | Neumann | C25B 1/00 |

FOREIGN PATENT DOCUMENTS

| | | | |
|---|---|---|---|
| WO | 07142727 | A1 | 12/2007 |
| WO | 2013057079 | A1 | 4/2013 |

(Continued)

OTHER PUBLICATIONS

Kuepper, Karsten, et al. Electronic structure and soft-X-ray-induced photoreduction studies of iron-based magnetic polyoxometalates of type {(M) M 5} 12 Fe III 30 (M= Mo VI, W VI). Dalton Transactions, 2013, 42.22: 7924-7935.

(Continued)

*Primary Examiner* — Wojciech Haske
(74) *Attorney, Agent, or Firm* — Andrew Metrailer

(57) ABSTRACT

This invention is directed to a method of oxygenating hydrocarbons with molecular oxygen, $O_2$, as oxidant under electrochemical reducing conditions, using polyoxometalate compounds based on the so-called Keplerate capsules, such as $[\{(W^{VI})W^{VI}_5O_{21}(SO_4)\}_{12}\{(Fe(H_2O))_{30}\}(SO_4)_{13}(H_2O)_{34}]^{32-}$ or $[\{(Mo^{VI})Mo^{VI}_5O_{21})(X'_1)_6\}_{12}\{Fe^{III}(H_2O)(X_1)\}_{30}]$ or solvates thereof as catalysts, wherein $X'_1$ and $X_1$ are each independently selected from $H_2O$, $Mo_2O_8^{2-}$, $Mo_2O_9^{2-}$, $CH_3COO^-$ (acetate), or any combination thereof.

41 Claims, 1 Drawing Sheet

(56) References Cited

FOREIGN PATENT DOCUMENTS

| | | | | |
|---|---|---|---|---|
| WO | WO-2015063763 | A1 * | 5/2015 | ..... C01B 3/16 |
| WO | 2015132780 | A1 | 9/2015 | |
| WO | WO2018225066 | A1 | 12/2018 | |

OTHER PUBLICATIONS

Neumann, Ronny. Activation of molecular oxygen, polyoxometalates, and liquid-phase catalytic oxidation. Inorganic chemistry, 2010, 49.8: 3594-3601.

IL Examination and Search Report dated Jan. 28, 2018, Israel Application No. PCT/IL2018/050613.

Foreign Communication from a Related Counterpart—International Search Report and Written Opinion, dated Sep. 17, 2018, PCT Application No. PCT/IL2018/050613, filed on Jun. 6, 2018.

Foreign Communication from a Related Counterpart—International Report on Preliminary Patentability, dated Dec. 10, 2019, PCT Application No. PCT/IL2018/050613, filed on Jun. 6, 2018.

Sarma, Bidyut Bikash, et al., "Oxygenation of Methylarenes to Benzaldehyde Derivatives by a Polyoxometalate Mediated Electron Transfer-Oxygen Transfer Reaction in Aqueous Sulfuric Acid," Journal of the American Chemical Society, vol. 137. No. 18. May 13, 2015 (May 13, 2015), pp. 5916-5922. XP055505325, ISSN 0002-7863. DOI: 10.1021jjacs.5b01745 abstract.

Sadakane, Masahiro, et al., "Electrochemical Properties of Polyoxometalates as Electrocatalysts Contents," Chem. Rev., vol. 98. Feb. 1, 1998 (Feb. 1, 1998), pp. 219-237, XP055498153, p. 232-p. 234.

Folkman, Scott J., et al., "Electrochemical Water Oxidation Catalysis Beginning with Co(II) Polyoxometalates: The Case of the Precatalyst CO4V2W18O6810-," ACS Catalysis, vol. 7. No. 1. Jan. 6, 2017 (Jan. 6, 2017), pp. 7-16. XP055505326, US ISSN: 2155-5435. DOI: 10.1021/acscatal.6b02244 abstract.

Dimitratos, Nikolaos, et al., "Effect of Bronsted acidity in propane oxidation over Cs2.5H1.5PV1Mo11-xWxO40 polyoxometallate compounds," Catalysis Communications, Elsevier, Amsterdam, NL, vo 1, 7. No. 10, Oct. 1, 2006 (Oct. 1, 2006), pp. 811-818, XP024973080, ISSN: 1566-7367, DOI: 10.1016/J.CATCOM.2006.02.024 [retrieved on Oct. 1, 2006] abstract.

Arakawa, H. et al. Catalysis research of relevance to carbon management: progress, challenges, and opportunities. Chem. Rev. 101, 953-996 (2001).

Bergman, R. G. Organometallic chemistry: C—H activation. Nature 446, 391-393 (2007).

Tomkins, P.; Ranocchiari, M.; van Bolchoven, J. A. Direct conversion of methane to methanol under mild conditions over Cu-Zeolites and beyond. Acc. Chem. Res. 50, 418-425 (2017).

Narsimhan, K.; Iyoki, K.; Dinh, K.; Román-Leshkov, Y. Catalytic Oxidation of Methane into Methanol over Copper-Exchanged Zeolites with Oxygen at Low Temperature. ACS Cent. Sci. 2, 424-429 (2016).

Panov, G. I.; Sobolev, V. I.; Kharitonov, A. S. The role of iron in N2O decomposition on ZSM-5 zeolite and reactivity of the surface oxygen formed. J. Mol. Catal. 61, 85-97 (1990).

Snyder, B. E. R.; Vanelderen, P.; Bols, M. L.; Hallaert, S. D.; Bottger, L. H.; Ungur, L.; Pierloot, K.; Schoonheydt, R. A.; Sels, B. F.; Solomon, E. I. The active site of low-temperature methane hydroxylation in iron-containing zeolites. Nature 536, 317-321 (2016).

Alayon, E. M. C.; Nachtegaal, M.; Bodi, A.; van Bokhoven, J. A. Reaction Conditions of Methane-to-Methanol Conversion Affect the Structure of Active Copper Sites. ACS Catal. 4, 16-22 (2104).

Tomkins, P.; Mansouri, A.; Bozbag, S. E.; Krumeich, F.; Park, M. B.; Alayon, E. M. C.; Ranocchiari, M.; van Bokhoven, J. A. Isothermal Cyclic Conversion of Methane into Methanol over Copper-Exchanged Zeolite at Low Temperature. Angew. Chem. 128, 5557-5561 (2016).

Sun, M.; Zhang, J.; Putaj, P.; Caps, V.; Lefebvre, F.; Pelletier, J.; Basset, J. M. Catalytic oxidation of light alkanes (C1—C4) by heteropoly compounds. Chem. Rev. 114, 981-1019 (2014).

Kopilevich, S.; Gil, A.; Garcia-Ratés, M.; Bonet-Ávalos, J.; Bo, C.; Müller, A.; Weinstock, I. A. Catalysis in a porous molecular capsule: Activation by regulated access to sixty metal centers spanning a truncated icosahedron. J. Am. Chem. Soc. 134, 13082-13088 (2012).

Kopilevich, S.; Müller, A.; Weinstock, I. A. Amplified rate acceleration by simultaneous up-regulation of multiple active sites in an endo-functionalized porous capsule. J. Am. Chem. Soc. 137, 12740-12743 (2015).

* cited by examiner

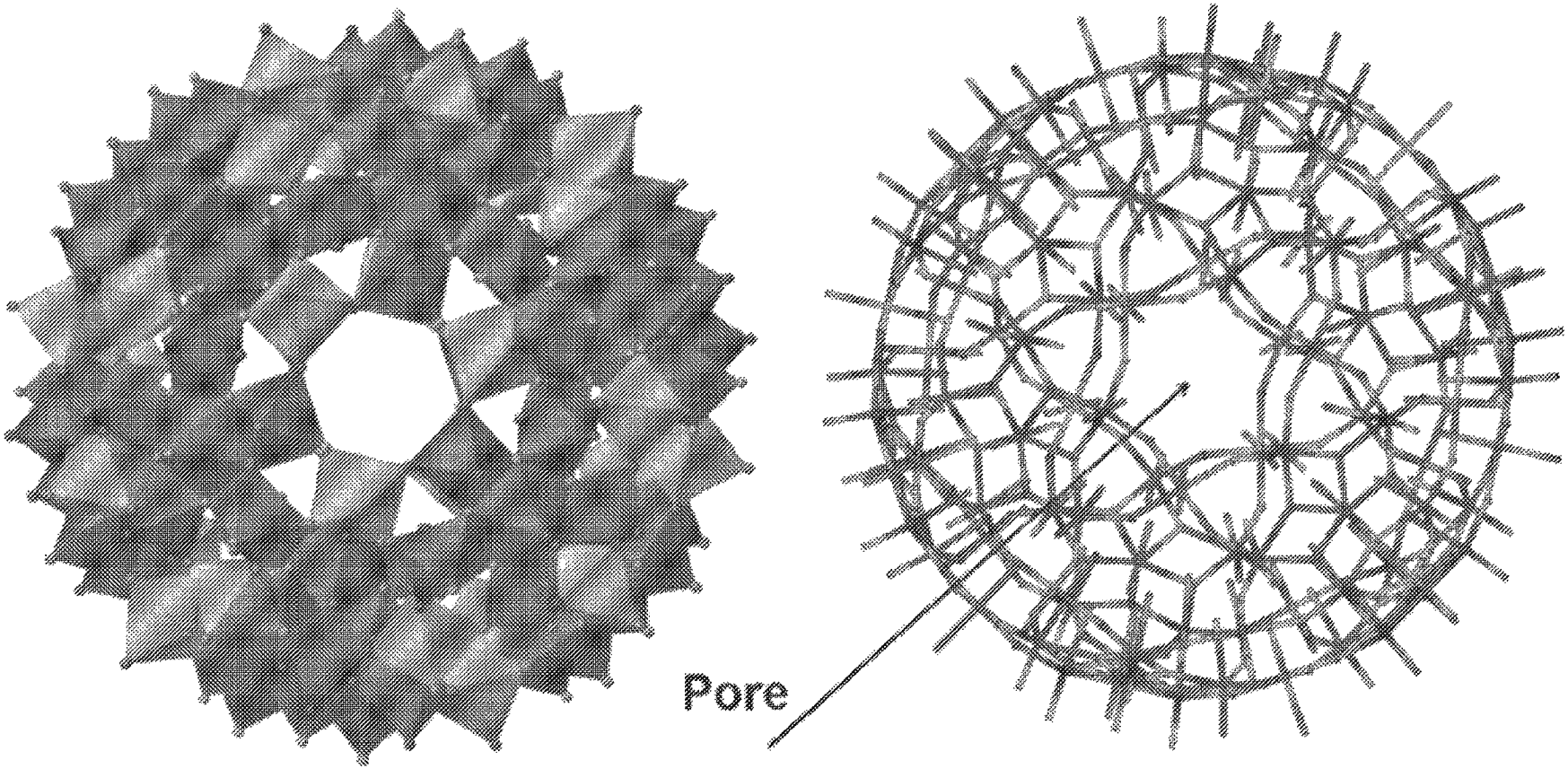
Pore

ELECTROCHEMICAL OXYGENATION OF HYDROCARBONS

CROSS-REFERENCE TO RELATED APPLICATIONS

This application is a filing under 35 U.S.C. 371 as the National Stage of International Application No. PCT/IL2018/050613, filed on Jun. 6, 2018, entitled, "ELECTROCHEMICAL OXYGENATION OF HYDROCARBONS," which claims the benefit of and claims priority to IL Provisional Application No. 252758, filed on Jun. 7, 2017 and entitled "Electrochemical Oxygenation of Hydrocarbons", both of which are incorporated herein by reference in their entirety for all purposes.

FIELD OF THE INVENTION

This invention is directed to a method of oxygenating hydrocarbons with molecular oxygen, $O_2$, as oxidant under electrochemical reducing conditions, using polyoxometalate compounds based on the so-called Keplerate capsules, such as $[\{(W^{VI})W^{VI}O_{21}(SO_4)\}_{12}\{(Fe(H_2O))_{30}\}(SO_4)_{13}(H_2O)_{34}]^{32-}$ or $[\{(Mo^{VI})Mo^{VI}{}_5O_{21})(X'_1)_6\}_{12}\{Fe^{III}(H_2O)(X_1)\}_{30}]$ or solvates thereof as catalysts, wherein $X'_1$ and $X_1$ are each independently selected from $H_2O$, $Mo_2O_8^{2-}$, $Mo_2O_9^{2-}$, $CH_3COO^-$ (acetate), or any combination thereof.

BACKGROUND OF THE INVENTION

The oxygenation of hydrocarbons with dioxygen from air, especially low molecular weight gaseous alkanes and alkenes, is still a major challenge in oxidation catalysis that could have significant economic and industrial importance. (Arakawa, H. et al. Catalysis research of relevance to carbon management: progress, challenges, and opportunities. Chem. Rev. 101, 953-996 (2001); and Bergman, R. G. Organometallic chemistry: C—H activation. Nature 446, 391-393 (2007)).

Some desirous transformations include alkane hydroxylation and further oxidation to aldehydes and carboxylic acids as well as alkene epoxidation and further carbon-carbon bond cleavage reactions.

The incorporation of copper and iron into zeolites and metal organic framework materials has led to demonstrated carbon-hydrogen bond activation of methane to form methanol via proposed active metal-oxo species, but catalytic cycles have only been perpetuated using nitrous oxide as oxygen donor or carried out in a three-step reaction requiring high temperature activation, typically at 450° C., of $O_2$ and use of steam at elevated temperatures to remove methanol from the catalysts (Tomkins, P.; Ranocchiari, M.; van Bolchoven, J. A. Direct conversion of methane to methanol under mild conditions over Cu-Zeolites and beyond. Acc. Chem. Res. 50, 418-425 (2017); Narsimhan, K.; Iyoki, K.; Dinh, K.; Roman-Leshkov, Y. Catalytic Oxidation of Methane into Methanol over Copper-Exchanged Zeolites with Oxygen at Low Temperature. ACS Cent. Sci. 2, 424-429 (2016); Panov, G. I.; Sobolev, V. I.; Kharitonov, A. S. The role of iron in N2O decomposition on ZSM-5 zeolite and reactivity of the surface oxygen formed. J. Mol. Catal. 61, 85-97 (1990); Snyder, B. E. R.; Vanelderen, P.; Bols, M. L.; Hallaert, S. D.; Bottger, L. H.; Ungur, L.; Pierloot, K.; Schoonheydt, R. A.; Sels, B. F.; Solomon, E. I. The active site of low-temperature methane hydroxylation in iron-containing zeolites. Nature 536, 317-321 (2016); Alayon, E. M. C.; Nachtegaal, M.; Bodi, A.; van Bokhoven, J. A. Reaction Conditions of Methane-to-Methanol Conversion Affect the Structure of Active Copper Sites. ACS Catal. 4, 16-22 (2104); and Tomkins, P.; Mansouri, A.; Bozbag, S. E.; Krumeich, F.; Park, M. B.; Alayon, E. M. C.; Ranocchiari, M.; van Bokhoven, J. A. Isothermal Cyclic Conversion of Methane into Methanol over Copper-Exchanged Zeolite at Low Temperature. Angew. Chem. 128, 5557-5561 (2016)).

The gap between dioxygen activation, that is formation of reactive intermediates, and actual catalytic transformations, especially of light hydrocarbons and alkanes under convenient aerobic conditions, using intrinsically stable inorganic catalysts, has not been effectively bridged.

Polyoxometalates have been used in very high temperature oxygenation of alkanes, although selectivity and yields are low with significant formation of combustion products. (Sun, M.; Zhang, J.; Putaj, P.; Caps, V.; Lefebvre, F.; Pelletier, J.; Basset, J. M. Catalytic oxidation of light alkanes (C1-C4) by heteropoly compounds. Chem. Rev. 114, 981-1019 (2014).). In recent years, polyoxometalate capsules consisting of 132 molybdenum atoms, $\{Mo_{132}\}$ have shown very high activity for acid catalysis such as the hydrolysis of ethers. (Kopilevich, S.; Gil, A.; Garcia-Ratés, M.; Bonet-Ávalos, J.; Bo, C.; Müller, A.; Weinstock, I. A. Catalysis in a porous molecular capsule: Activation by regulated access to sixty metal centers spanning a truncated icosahedron. J. Am. Chem. Soc. 134, 13082-13088 (2012); and Kopilevich, S.; Müller, A.; Weinstock, I. A. Amplified rate acceleration by simultaneous up-regulation of multiple active sites in an endo-functionalized porous capsule. J. Am. Chem. Soc. 137, 12740-12743 (2015)).

This invention provides a method of oxygenating hydrocarbons, using catalytic polyoxometalate compounds such as $Na_6(NH_4)_{20}(Fe^{III}(H_2O)_6)_2[\{(W^{VI})W^{VI}{}_5O_{21}(SO_4)\}_{12}\{(Fe(H_2O))_{30}\}(SO_4)_{13}(H_2O)_{34}].n\ H_2O$ and molecular oxygen under electrochemical reducing conditions.

SUMMARY OF THE INVENTION

In one embodiment, this invention is directed to a method for the preparation of oxygenated hydrocarbon products from a hydrocarbon, comprising the step of contacting a hydrocarbon with molecular oxygen and with a polyoxometalate catalyst of the general formula (1):

$$Q_i[\{(M)M_5O_{21}(X')_o\}_j\{(M'(H_2O))_k\}(X)_1(H_2O)_m].$$ or a solvate thereof;

wherein:

i is between 0-50;
j is between 5-20;
k is between 0-50;
l is between 5-50;
m is between 0-50;
o is between 0-10;
each of Q is independently absent or the same or a different metal or $NH_4^+$ cation;
each of X is independently $H_2O$ or the same or a different anion;
each of X' is independently $H_2O$ or the same or a different anion;
each of M is independently Mo or W; and
each of M' is independently Fe, V, Cr, Mn, Co, Ni, or Cu;
wherein said contacting step is conducted in an electrochemical cell, said electrochemical cell comprises a cathode, an anode and a catalyst and wherein voltage is applied to said cell, thereby generating the oxygenated hydrocarbon products.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

FIG. 1 depicts a polyhedral (left) and stick (right) presentation of the poly oxometalate, $Na_6(NH_4)_{20}(Fe^{III}(H_2O)_6)_2[\{(W^{VI})W^{VI}{}_5O_{21}(SO_4)\}_{12}\{(Fe(H_2O))_{30}1\}(SO_4)_{13}(H_2O)_{34}]\cdot n\ H_2O$. The sulfate anions on the inner surface of the capsule and the counter cations outside the capsule are not shown. The pore into the capsule is pointed to by the arrowed line.

It will be appreciated that for simplicity and clarity of illustration, elements shown in the FIGURES have not necessarily been drawn to scale. For example, the dimensions of some of the elements may be exaggerated relative to other elements for clarity. Further, where considered appropriate, reference numerals may be repeated among the FIGURES to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

In one embodiment, the invention provides a method for the preparation of oxidized hydrocarbon products from a hydrocarbon, comprising the step of contacting a hydrocarbon with a polyoxometalate catalyst or a solvate thereof with a molecular oxygen, wherein said step is conducted in an electrochemical cell, thereby generating the oxidized hydrocarbon products.

In another embodiment, the oxidized hydrocarbon products are oxygenated hydrocarbon products.

In one embodiment, this invention is directed to a method for the preparation of oxygenated hydrocarbon products from a hydrocarbon, comprising the step of contacting a hydrocarbon with molecular oxygen and with a polyoxometalate catalyst of the general formula (1):

$$Q_i[\{(M)M_5O_{21}(X')_o\}_j\{(M'(H_2O))_k\}(X)_l(H_2O)_m]\cdot \quad (1)$$

or a solvate thereof;

wherein:

i is between 0-50;
j is between 5-20;
k is between 0-50;
l is between 5-50;
m is between 0-50;
o is between 0-10;
each of Q is independently absent or the same or a different metal or $NH_4^+$ cation;
each of X is independently $H_2O$ or the same or a different anion;
each of X' is independently $H_2O$ or the same or a different anion;
each of M is independently Mo or W; and
each of M' is independently Fe, V, Cr, Mn, Co, Ni or Cu;
wherein said contacting step is conducted in an electrochemical cell, said electrochemical cell comprises a cathode, an anode and a catalyst and wherein voltage is applied to said cell, thereby generating the oxygenated hydrocarbon products.

In one embodiment, this invention is directed to a method for the preparation of oxygenated hydrocarbon products from a hydrocarbon, comprising the step of contacting a hydrocarbon with molecular oxygen and with a polyoxometalate catalyst of the general formula (2):

$$Q_i[\{(M)M_5O_{21}(X')_o\}_j\{(M'(H_2O))_k\}(X)_l(H_2O)_m]\cdot n\cdot H_2O \quad (2);$$

wherein:

i is between 0-50;
j is between 5-20;
k is between 0-50;
l is between 5-50;
m is between 0-50;
n is between 0-1000;
o is between 0-10;
each of Q is independently absent or the same or a different metal or $NH_4^+$ cation;
each of X is independently $H_2O$or the same or a different anion;
each of X' is independently $H_2O$ or the same or a different anion;
each of M is independently Mo or W; and
each of M' is independently Fe, V, Cr, Mn, Co, Ni, or Cu;
wherein said contacting step is conducted in an electrochemical cell, said electrochemical cell comprises a cathode, an anode and a catalyst and wherein voltage is applied to said cell, thereby generating the oxygenated hydrocarbon products.

In some embodiments, the polyoxometalate catalyst used in the method of this invention is of the general formula (3):

$$Q_i[\{(W^{VI})W^{VI}{}_5O_{21}(X')_o\}_j\{(Fe(H_2O))_k\}(X)_l(H_2O)_m].n\ H_2O \quad (3);$$

wherein Q, X, X' i, j, k, l, m, n and o are as defined for formula (1).

In another embodiment, the polyoxometalate catalyst is of formula (4) referred also as "$\{Fe^{III}{}_{30}W^{VI}{}_{72}\}$" or as "$\{Fe_{30}W_{72}\}$":

$$Na_6(NH_4)_{20}(Fe^{III}(H_2O)_6)_2[\{W^{VI})W^{VI}{}_5O_{21}(SO_4)\}_{12}\{(Fe(H_2O))_{30}\}(SO_4)_{13}(H_2O)_{34}]\cdot nH_2O, \quad (4)$$

(FIG. 1);

wherein n is as defined for formula (1).

In another embodiment, the polyoxometalate catalyst is of formula (5):

$$Na_6(NH_4)_{20}(Fe^{III}(H_2O)_6)_2[\{W^{VI})W^{VI}{}_5O_{21}(SO_4)\}_{12}\{(Fe(H_2O))_{30}\}(SO_4)_{13}(H_2O)_{34}]\cdot 200\ H_2O, \quad (5)$$

In one embodiment, the polyoxometalate catalyst used in the method of this invention is of formula (6), referred also as "$\{Fe^{III}{}_{30}Mo^{VI}{}_{72}\}$" or as "$\{Fe_{30}Mo_{72}\}$".

$$[\{Mo^{VI})Mo^{VI}{}_5O_{21})(X'_1)_6\}_{12}\{Fe^{III}(H_2O)(X_1)\}_{30}]\bullet n\ H_2O, \quad (6)$$

wherein n is between 0 and 1000;

$X'_1$ and $X_1$ are each independently selected from $H_2O$, $Mo_2O_8{}^{2-}$, $Mo_2O_9{}^{2-}$ and $CH_3COO^-$ (acetate); the compound (formula (6)) comprises 12 $CH_3COO^-$ (acetate) anions and 3 (three) dimolybdate anions; and each dimolybdate anion is $Mo_2O_8{}^{2-}$ or $Mo_2O_9{}^2$ anion.

In one embodiment, this invention is directed to a sustainable and green method to produce oxygenated hydrocarbons from hydrocarbons. In another embodiment, such method comprises a catalyst, using cheap and abundant starting materials. In another embodiment, the method is conducted under mild conditions of temperature, voltage and solvent or solvent-less environment.

In view of the mild conditions of the method of this invention, surprisingly good faradaic efficiency and selectivity of the resulting oxygenated hydrocarbons are obtained.

In one embodiment, the invention provides a method for the preparation of oxygenated hydrocarbon products from a hydrocarbon, comprising the step of contacting a hydrocarbon with a polyoxometalate catalyst or a solvate thereof with molecular oxygen. In another embodiment, the molecular oxygen is used as an oxidant in the method of this invention.

In one embodiment, a "molecular oxygen" refers herein to pure $O_2$ or to any gas composition comprising $O_2$. In another embodiment, a gas composition comprising $O_2$ includes air, diluted air, concentrated air, mixtures of $O_2$ and an inert gas, mixtures of $O_2$ and hydrocarbon of this invention, or any mixtures thereof. In some embodiments, an inert gas comprises He, $N_2$, Ar or any mixture thereof. Each possibility represents a separate embodiment of the invention.

In another embodiment, the polyoxometalate catalyst is contacted with a gas composition comprising $O_2$.

In some embodiments, a polyoxometalate catalyst of formula (1), (2), (3), (4), (5) or (6) is used in the method of this invention.

In one embodiment, i of formula (1), (2) or (3) is between 0-50. In another embodiment, i is between 0-10. In another embodiment, i is between 10-20. In another embodiment, i is between 10-50. In another embodiment, i is between 20-30. In another embodiment, i is between 30-40. In another embodiment, i is between 40-50. In another embodiment, i is 0. In another embodiment, i is 28.

In one embodiment, j of formula (1), (2) or (3) is between 5-20. In another embodiment, j is between 10-14. In another embodiment, j is between 5-15. In another embodiment, j is between 15-20. In another embodiment, j is 12.

In one embodiment, k of formula (1), (2) or (3) is between 0-50. In another embodiment, k is between 25-35. In another embodiment, k is 0. In another embodiment, k is between 20-40. In another embodiment, k is 30.

In one embodiment, 1 of formula (1), (2) or (3) is between 5-50. In another embodiment, l is between 5-10. In another embodiment, l is between 10-15. In another embodiment, l is between 5-15. In another embodiment, l is between 5-20. In another embodiment, l is between 10-20. In another embodiment, l is between 20-30. In another embodiment, l is between 30-40. In another embodiment, l is between 40-50. In another embodiment, 1 is 13. In another embodiment, k is 30.

In one embodiment, m of formula (1), (2) or (3) is between 0-50. In another embodiment, m is between 20-35. In another embodiment, m is 0. In another embodiment, m is between 10-30. In another embodiment, m is between 15-40. In another embodiment, m is 34. In another embodiment, m is 0.

In one embodiment, n of formula (1), (2), (3), (4) or (6) is between 0-1000. In another embodiment, n is between 0-10. In another embodiment, n is between 10-20. In another embodiment, n is between 20-50. In another embodiment, n is between 50-100. In another embodiment, n is between 100-200. In another embodiment, n is between 200-500. In another embodiment, n is between 500-1000. In another embodiment, n is 200.

In one embodiment, o of formula (1), (2) or (3) is between 0-10. In another embodiment, o is between 0-5. In another embodiment, o is between 5-10. In another embodiment, o is 1. In another embodiment, o is 1. In another embodiment, o is between 1-10.

In one embodiment, the polyoxometalate catalyst of this invention is stabilized on the exterior by counter cations, denoted as Q and stabilized within the inner surface by inner surface bound anions, inner surface bound water molecules ($H_2O$) or any combination thereof, denoted as X and X'.

In some embodiments, Q of formula (1), (2), (3) or (6) is a metal cation or $NH_4^+$. In another embodiment, Q is $NH_4^+$. In another embodiment, Q is an alkali metal cation, an alkaline earth metal cation, a transition metal cation or a lanthanide cation. In one embodiment Q comprises Li, Na, K, Rb, Cs, Be, Mg, Ca, Sr, Ba, Ra, Sc, Ti, V, Cr, Mn, Fe, Co, Ni, Cu, Zn, Zr, Nb, Mo, Tc, Ru, Rh, Pd, Ag, Cd, Hf, Ta, W, Re, Os, Ir, Pt, Au, Hg, Ac, La, Ce, Pr, Nd, Pm, Sm, Eu, Gd, Tb, Dy, Ho, Er, Tm, Yb, Lu cation or combination thereof. In another embodiment, each represents a separate embodiment of this invention. In some embodiments, each oxidation state of the abovementioned metal cations, as known in the art, is a separate embodiment of this invention. In another embodiment, Q is $Fe^{III}$ cation. In another embodiment, Q is $Fe^{II}$ cation. In another embodiment, Q is absent. In some embodiments, Q is solvated. Each solvation state of the abovementioned Q cations, is a separate embodiment of this invention. In another embodiment, the solvation state is a hexasolvate (six solvent molecules coordinating the cation). In another embodiment, Q is not solvated. In another embodiment, the Q groups in a polyoxometalate are the same or different from each other. In another embodiment, each of Q is the same. In another embodiment, not all of Q are the same. In another embodiment, $Q_i$ is a combination of cations. In another embodiment, $Q_i$ is a combination of $NH_4^+$, Na cations and Fe cations. In another embodiment, $Q_i$ is $Q_{28}$. In another embodiment, $Q_{28}$ is $\{Na_6(NH_4)_{20}(Fe^{III}(H_2O)_6)_2\}^{32+}$.

In some embodiments, X and/or X' of formula (1), (2), (3) are/is the inner surface bound anion/s or water molecule/s ($H_2O$) within the polyoxometalate catalysts used in this invention. In another embodiment, X and/or X' of formula (1), (2) or (3) have/has a structure directing/templating effect. In another embodiment, X and/or X' of formula (1), (2) or (3) are/is each independently $H_2O$. In another embodiment, X and/or X' of formula (1), (2) or (3) are/is each independently any oxyanion or carboxylate anion as known in the art. In some embodiments, X and/or X' of formula (1), (2) or (3) comprise methanesulfonate (mesylate), benzenesulfonate, trifluorosulfonate (triflate), an alkylphosphonate, an alkylsulfonate, sulfate, bisulfate, borate, bicarbonate, phosphate ($PO_4^{3-}/HPO_4^{2-}/H_2PO_4^-$), chlorate, perchlorate, perbromate, periodate, germanate, metagermanate, silicate, metasilicate, nitrate, formate, acetate, propionate, butanoate, pentanoate, hexanoate, heptanoate, octanoate, nonaoate, decanoate, carbonate, bicarbonate, fumarate, oxalate, maleate, succinate, glutarate, adipate, halogenated carboxylates, hydroxycarboxylates, mercaptocarboxylates, alkoxycarboxylates, alkylsulfates, alkylphosphates, $Mo_2O_8^{2-}$, $Mo_2O_9^{2-}$, $X'_1$, $X_1$ or any combination thereof, wherein $X'_1$ and $X_1$ are each independently selected from $H_2O$, $Mo_2O_8^{2-}$, $Mo_2O_9^{2-}$ and $CH_3COO^-$ (acetate). Each possibility represents a separate embodiment of the invention.

In another embodiment, the anion X and/or X' are each independently sulfate ($SO_4^{2-}$). In another embodiment, the anion is bisulfate ($HSO_4^-$). In another embodiment, the anion is formate ($HCOO^-$). In another embodiment, the anion is acetate ($CH_3COO^-$). In another embodiment, the anion is trifluoroacetate ($CF_3COO^-$). In another embodiment, the anion is methanesulfonate (mesylate). In another embodiment, the anion is benzenesulfonate. In another embodiment, the anion is alkylsulfonate. In another embodiment, the anion is alkylphosphonate. In another embodiment, the anion is trifluorosulfonate. In another embodiment, the anion is phosphate ($PO_4^{3-}/HPO_4^{2-}/H_2PO_4^-$).

In some embodiments, both X and X' are sulfate ($SO_4^{2-}$). In some embodiments, X is $X_1$ and X' is $X'_1$, wherein $X'_1$ and $X_1$ are each independently selected from $H_2O$, $Mo_2O_8^{2-}$, $Mo_2O_9^{2-}$, and $CH_3COO^-$ (acetate). In another embodiment, the polyoxometalate catalyst is of formula (6); the catalyst comprises 12 $CH_3COO^-$ (acetate) anions and 3 (three) dimolybdate anions; and each dimolybdate anion is $Mo_2O_8^{2-}$ or $Mo_2O_9^{2-}$ anion. In another embodiment, an alkylsulfonate refers to any alkyl group as described herein bonded to a sulfonate (—$SO_3H$/—$SO_3^-$) group.

In another embodiment, an alkylphosphonate refers to any alkyl group as described herein bonded to a phosphonate group (—$PO_3H_2$/—$PO_3H^-$/—$PO_3^{2-}$).

In one embodiment, "halogenated carboxylate" refers to a carboxylate comprising at least one halide (—F/—Cl/—Br/—I) as substituent.

In one embodiment, "mercaptocarboxylate" refers to a carboxylate comprising at least one mercapto (—SH) as a substituent.

In one embodiment, "hydroxycarboxylate" refers to a carboxylate comprising at least one hydroxyl (—OH) as substituent.

In one embodiment, "alkoxycarboxylate" refers to a carboxylate comprising at least one alkoxy (—Oalkyl) as substituent.

In one embodiment, "alkylsulfate" refers to any alkyl group as described herein bonded to a sulfate group (—O—$SO_3^{2-}$) as substituent.

In one embodiment, "alkylphospate" refers to any alkyl group as described herein bonded to a phosphate group (—O—$PO_4^{3-}$) as substituent.

In some embodiments, M and M' are the same or different transition metals. In one embodiment, M and M' are the same transition metals. In one embodiment, M and M' are different transition metals. In some embodiments, both M and M' are redox active transition metals. In another embodiment, M' is a redox active transition metal. In another embodiment, each of M is independently selected from Mo and W. In another embodiment, M is Mo. In another embodiment, M is W. In another embodiment, each of M' is independently selected from Fe, V, Cr, Mn, Co, Ni, and Cu. In another embodiment, M' is V. In another embodiment, M' is Cr. In another embodiment, M' is Mn. In another embodiment, M' is Co. In another embodiment, M' is Ni. In another embodiment, M' is Cu. In another embodiment M' is Fe. In one embodiment M' is the same as Q. In another embodiment M' is different than the metal cation Q.

In some embodiments, polyoxometalate catalyst of formula (1) is found in solvated forms, for example hydrates. Thus, the present invention provides the use of polyoxometalate solvates, such as but not limited to polyoxometalate hydrates. Other solvate molecules of polyoxometalate catalyst include, but are not limited to diethylether, acetonitrile, dimethylsulfoxide, tetrahydrofuran, methanol, ethanol, sulfolane, dioxane, hexamethylphosphoramide (HMPA), hexamethylphosphorous triamide (HMPT), dimethylformamide (DMF) or dimethylacetamide (DMA) solvates. In one embodiment, the polyoxometalate comprises between 0-1000 solvate molecules. In another embodiment, the polyoxometalate comprises between 0-1 solvate molecules. In another embodiment, the polyoxometalate is not solvated. In another embodiment, the polyoxometalate comprises between 1-2 solvate molecules. In another embodiment, the polyoxometalate comprises between 2-5 solvate molecules. In another embodiment, the polyoxometalate comprises between 5-10 solvate molecules. In another embodiment, the polyoxometalate comprises between 10-20 solvate molecules. In another embodiment, the polyoxometalate comprises between 20-50. In another embodiment, the polyoxometalate comprises between 50-100 solvate molecules. In another embodiment, the polyoxometalate comprises between 100-200 solvate molecules. In another embodiment, the polyoxometalate comprises between 200-500 solvate molecules. In another embodiment, the polyoxometalate comprises between 500-1000 solvate molecules. In another embodiment, the polyoxometalate has 200 solvate molecules.

In some embodiments, the polyoxometalate catalysts used in this invention are spherical, stable metal oxide based porous nanocapsules, which comprise gated pores and structured, tunable external as well as internal surfaces. In another embodiment, tuning of surfaces within the polyoxometalate catalysts is achieved by altering Q, X and X' thereof.

In one embodiment, the method of this invention for the preparation of oxygenated hydrocarbon comprises a hydrocarbon as a reactant. In one embodiment, the hydrocarbon comprises alkanes, alkenes, cycloalkanes, cycloalkenes, arenes, alkylated arenes, alkenylated arenes, heteroarenes, alkylated heteroarenes, alkenylated heteroarenes or any mixture thereof. In another embodiment, the hydrocarbon is a light hydrocarbon. In another embodiment, the hydrocarbon is an alkane. In another embodiment, the hydrocarbon is an alkene. In another embodiment, the hydrocarbon is a cycloalkane. In another embodiment, the hydrocarbon is a cycloalkene. In another embodiment the hydrocarbon is an arene. In another embodiment the hydrocarbon is an alkylated arene. In another embodiment the hydrocarbon is an alkenylated arene. In another embodiment the hydrocarbon is a heteroarene. In another embodiment the hydrocarbon is an alkylated heteroarene. In another embodiment the hydrocarbon is an alkenylated heteroarene.

As used herein alkane refers, in one embodiment, to a saturated aliphatic hydrocarbon, including both straight-chain or branched-chain alkanes. In one embodiment, the alkane has 1-10 carbons. In one embodiment, the alkane has 1-20 carbons. In one embodiment, the alkane compound is methane. In one embodiment, the alkane is ethane. In one embodiment, the alkane is propane. In another embodiment, the alkane is n-butane. In some embodiments, the alkane is isobutane (2-methylpropane), n-pentane, methylbutane (isopentane), neopentane (dimethylpropane), n-hexane, 2-methylpentane (isohexane), 3-methylpentane, 2,3-dimethylbutane, 2,2-dimethylbutane (neohexane), n-heptane, 2-methylhexane (isohexane), 3-methylhexane, 2,3-dimethylpentane, 2,2-dimethylpentane (neoheptane), 2,4-dimethylpentane, 3-ethylpentane, 2,2,3-trimethylbutane, n-octane and/or any isomer thereof, n-nonane and/or any isomer thereof, n-decane and/or any isomer thereof. In another embodiment, the alkane may be optionally substituted by one or more halogens, hydroxides, alkoxides, carboxylic acids, amides, cyano groups, and nitro groups. Each possibility represents a separate embodiment of the invention.

As used herein alkene refers, in one embodiment, to an unsaturated aliphatic hydrocarbon, including straight-chain and branched-chain groups. In one embodiment, the alkene has one double bond. In another embodiment, the alkene has 2-10 carbons. In another embodiment, the alkene has more than one double bond. In another embodiment, the alkene has between 2-6 double bonds, each possibility represents a separate embodiment of this invention. In one embodiment, the alkene has 2-20 carbons. The alkene may be unsubstituted or substituted by one or more halogens, cyano groups, hydroxides, alkoxides, amides, carboxylic acids and nitro groups. Each possibility represents a separate embodiment of the invention. In another embodiment, the alkene is ethylene. In another embodiment, the alkene is maleic acid. In another embodiment, the alkene is propylene. In another embodiment, the alkene is 1-butylene. In another embodiment, the alkene is cis or trans 2-butylene. In some embodiments, non-limiting examples of an alkene include in addition 2-methylpropene (isobutylene), 1-pentene, cis or trans 2-pentene, 2-methylbut-1-ene, 3-methylbut-1-ene (isopentene), 2-methlbut-2-ene (isoamylene), 1-hexene and/or any isomer thereof, 1-heptene and/or any isomer thereof, 1-octene and/or any isomer thereof, 1-nonene and/or any isomer thereof, 1-decene and/or any isomer thereof and any combination thereof. Each possibility represents a separate embodiment of the invention.

As used herein cycloalkane refers, in one embodiment, to a ring structure comprising carbon atoms as ring atoms, which are saturated, substituted or unsubstituted. In another embodiment the cycloalkane has 3-12 membered ring. In another embodiment the cycloalkane has a 6 membered ring. In another embodiment the cycloalkane has a 5-7 membered ring. In another embodiment the cycloalkane has a 3-8 membered ring. In another embodiment, the cycloalkane may be unsubstituted or substituted by a halogen, an alkyl group, a haloalkyl group, a hydroxide, an alkoxide, an amido, a cyano group, a nitro group, and a carboxylate. In another embodiment, the cycloalkyl ring may be fused to another saturated or unsaturated 3-8 membered ring. Non-limiting examples of cycloalkanes include cyclohexane, cyclopropane cyclopentane, cyclobutane, cycloheptane, cyclooctane, methylcyclohexane, etc. Each possibility represents a separate embodiment of the invention.

As used herein cycloalkene refers, in one embodiment, to a ring structure comprising carbon atoms as ring atoms, which are partially unsaturated, that is having at least one double bond, substituted or unsubstituted. In another embodiment, the cycloalkene may be unsubstituted or substituted by a halogen, an alkyl group, a haloalkyl group, a hydroxide, an alkoxide, an amido, a cyano group, a nitro group, and a carboxylate. Non-limiting examples of cycloalkenes include cyclohexene, cyclopropene, cyclopentene, cyclobutene, cycloheptene, cyclooctene, cyclooctadiene (COD), etc. Each possibility represents a separate embodiment of the invention.

As used herein arene refers to a compound having an aromatic ring. In one embodiment, non-limiting examples of arenes include benzene, anthracene, phenanthrene, tetracene, pyrene, perylene and naphthalene. Each possibility represents a separate embodiment of the invention. In another embodiment, the arene may be unsubstituted or substituted by a halogen, an alkyl group, a haloalkyl group, a hydroxide, an alkoxide, an amido, a cyano group, a nitro group, and a carboxylate As used herein, the term alkylated arene refers to arene as described herein that is directly bonded to an alkyl as described herein and can be either substituted or unsubstituted. Exemplary alkylated arenes include, without limitation, toluene, xylene, mesitylene, ethylbenzene and isopropylbenzene. Each possibility represents a separate embodiment of the invention.

As used herein, the term alkenylated arene refers to arene as described herein that is directly bonded to an alkenyl as described herein and can be either substituted or unsubstituted. Exemplary alkenylated arenes include, without limitation, styrene, stilbene and methylstyrene. Each possibility represents a separate embodiment of the invention.

As used herein, the term alkenyl refers to an alkyl group as described herein, having at least one carbon double bond, including straight-chain and branched-chain groups. In one embodiment, the alkene has one double bond. In another embodiment, the alkene has more than one double bond. In another embodiment, the alkene has between 2-6 double bonds, each possibility represents a separate embodiment of this invention. In one embodiment, the alkene has 2-20 carbons. Non-limiting examples include ethylenyl, propylenyl, 2-methylpropyl-1-enyl and butenyl, each possibility represents a separate embodiment of this invention.

A "heteroarene" group refers in one embodiment, to arene as described herein comprising in addition to carbon atoms, sulfur, oxygen, nitrogen or any combination thereof, as part of the ring. In one embodiment, non-limiting examples of heteroarenes include pyrrole, furan, thiophene, imidazole, pyrazole, oxazole, isoxazole, thiazole, isothiazole, and pyridine. Each possibility represents a separate embodiment of this invention.

As used herein, the term alkylated heteroarene refers to heteroarene as described herein that is directly bonded to an alkyl as described herein and can be either substituted or unsubstituted. Exemplary alkylated heteroarenes include, without limitation, methylpyridine, ethylpyridine, methylfuran, and ethylthiophene. Each possibility represents a separate embodiment of this invention.

As used herein, the term alkenylated heteroarene refers to heteroarene as described herein that is directly bonded to an alkenyl as described herein and can be either substituted or unsubstituted. Exemplary alkenylated heteroarenes include, without limitation vinylpyridine and vinylthiophene. Each possibility represents a separate embodiment of this invention.

In one embodiment, this invention provides a method for the preparation of oxidized hydrocarbon products. In another embodiment, this invention provides a method for the preparation of oxygenated hydrocarbon products. In one embodiment, oxygenated hydrocarbon products are carbon-carbon bond cleavage products, carbon-hydrogen bond oxygenation products, carbon-carbon addition products, epoxides or a combination thereof. In another embodiment, the oxygenated hydrocarbon product is a carbon-carbon bond cleavage product. In another embodiment, the oxygenated hydrocarbon product is a carbon-hydrogen bond oxygenation product. In another embodiment, the oxygenated hydrocarbon product is a carbon-carbon addition product. In another embodiment the oxygenated hydrocarbon is an epoxide. In one embodiment, the oxygenated hydrocarbon product is any combination of the foregoing. In another embodiment, non-limiting examples of the carbon-carbon bond cleavage products are selected from aldehyde and/or hydrate thereof, ketone, carboxylic acid, α-oxo carboxylic acid and any combination thereof. In another embodiment, non-limiting examples of the carbon-hydrogen bond oxygenation product is selected from α-hydroxy carboxylic acid, α-hydroxy aldehyde and/or hydrate thereof, alcohol, diol, aldehyde, ketone, hydroxyarene, dihydroxyarene, and carboxylic acid.

In one embodiment, this invention provides a method for the preparation of hydroxyacetic acid, glycolic aldehyde, formic acid, formaldehyde and/or the optional hydrate thereof by oxygenation of ethylene.

In one embodiment, this invention provides a method for the preparation of acetic acid, acetaldehyde, formic acid, formaldehyde and/or the optional hydrate thereof, by oxygenation of propylene.

In one embodiment, this invention provides a method for the preparation of acetic acid by the oxygenation of ethane. In another embodiment, oxygenation of ethane yielded acetic acid with above than 97% selectivity. In another embodiment, formic acid was also found in less than 3%. The production of acetic acid from ethane in such high selectivity in view of the mild conditions of this invention is surprising.

In one embodiment, this invention provides a method for the preparation of acetic acid, formic acid, acetone, propanoic acid and optionally formaldehyde and/or the optional hydrate thereof by oxygenation of propane.

In one embodiment, this invention provides a method for the preparation of formic acid and formaldehyde and/or the optional hydrate thereof by oxygenation of methane.

In one embodiment, this invention provides a method for the preparation of tert-butanol, formaldehyde and/or the optional hydrate thereof, acetic acid, formic acid and/or acetone by oxygenation of isobutane.

In one embodiment, this invention provides a method for the preparation of phenol and hydroquinone by the oxygenation of benzene. In another embodiment, oxygenation of benzene yielded phenol and hydroquinone with above than 95% selectivity.

In one embodiment, this invention provides a method for the preparation of glyoxylic acid by the oxygenation of maleic acid.

In some embodiments, and without being bound to any particular mechanism or theory:

a) at least one M' of the polyoxometalate within the method of this invention is reduced by the applied electrochemical reducing conditions;
b) subsequent contact between the reduced species, the molecular oxygen and the hydrocarbon provides the oxygenated hydrocarbon products; and
c) finally, following the oxygenation of the hydrocarbons, the reoxidized, original M' of the polyoxometalate is regenerated, "closing" the catalytic cycle, reverting to step (a).

In another embodiment, M' is Fe(III) and the reduced M' is Fe(II). In another embodiment, M' is Mn(III) and the reduced M' is Mn(II). In another embodiment, M' is Cu(II) and the reduced M' is Cu(I).

In one embodiment, the method of this invention does not require a solvent, i.e. the reaction conducted is solventless. In another embodiment, the polyoxometalate catalyst of this invention is dissolved in a solvent to form a solvate thereof. In another embodiment, any solvent known in the art to be inert within the reaction conditions of this invention is suitable. In another embodiment, the solvent is selected from water, acetonitrile, sulfolane, diethyl ether, dimethyl-formamide (DMF), dimethylacetamide (DMA), dimethyl sulfoxide (DMSO), dioxane, ethanol, hexamethylphosphoramide, (HMPA), hexamethylphosphorous triamide (HMPT), methanol, and any combination thereof. Each possibility represents a separate embodiment of the invention. In another embodiment, the solvent is polar. In another embodiment, the solvent is acetonitrile. In another embodiment, the solvent is dioxane. In another embodiment, the solvent is acetic acid. In another embodiment, the solvent is water. In another embodiment, the solvent is sulfolane.

In some embodiments, "faradaic efficiency" is referred herein as the efficiency with which charge (electrons) is transferred in a system facilitating an electrochemical reaction. In one embodiment, the faradaic efficiency of the method of this invention is between 30-100%.

In one embodiment, the method of this invention is conducted at various temperatures. In one embodiment, the temperature is between 2-200° C. In another embodiment, the temperature is between 2-100° C. In another embodiment, the temperature is between 180-200° C. In another embodiment, the temperature is between 160-180° C. In another embodiment, the temperature is between 140-160° C. In another embodiment, the temperature is between 120-140° C. In another embodiment, the temperature is between 100-120° C. In another embodiment, the temperature is between 80-100° C. In another embodiment, the temperature is between 60-80° C. In another embodiment, the temperature is between 40-60° C. In another embodiment, the temperature is between 20-40° C. In another embodiment, the temperature is between 2-20° C. In another embodiment, the temperature is between 2-10° C. In another embodiment, the temperature is between 2-5° C. In another embodiment, the temperature is between 5-10° C. In another embodiment, the temperature is between 10-15° C. In another embodiment, the temperature is between 15-20° C. In another embodiment, the reaction is conducted at room temperature.

In some embodiments, the volume ratio between the molecular oxygen and the hydrocarbon (gas) is between 0.001-99.999% oxidant and 99.999-0.001% hydrocarbon (v/v). In another embodiment, the volume ratio between the molecular oxygen and the hydrocarbon (gas) is 0.001-1% oxidant and 99.999-99% hydrocarbon. In another embodiment, 1-10% molecular oxygen and 99-90% hydrocarbon. In another embodiment, 5-15% molecular oxygen and 95-85% hydrocarbon. In another embodiment, 5-20% oxidant and 95-80% hydrocarbon. In another embodiment, 50-80% oxidant and 50-20% hydrocarbon.

In one embodiment, the method of this invention is conducted under a total pressure of between 0.01-100 bar. In one embodiment, the "total pressure" refers to the sum of the partial pressures of all gaseous components included in the cell of this invention including a hydrocarbon (if gas), molecular oxygen or a gas composition comprising $O_2$, as described herein. In another embodiment, the partial pressure of each gaseous component is between 0.01-100 bar. In another embodiment, the total or partial pressure is between 0.01-0.05 bar. In another embodiment, the total or partial pressure is between 0.05-0.1 bar. In another embodiment, the total or partial pressure is between 0.1-0.5 bar. In another embodiment, the total or partial pressure is between 0.5-1 bar. In another embodiment, the total or partial pressure is o between 0.95-0.99 bar. In another embodiment, the total or partial pressure is of between 1-5 bar. In another embodiment, the total or partial pressure is between 5-10 bar. In another embodiment, the total or partial pressure is between 10-50 bar. In another embodiment, the total pressure is between 50-100 bar. In another embodiment, the total pressure is 1 bar. In another embodiment, the partial pressure of $O_2$ is between 0.01-0.05 bar. In another embodiment, the partial pressure of the hydrocarbon is 0.95-0.99 bar. In another embodiment, the partial pressure of $O_2$ is 0.05 bar. In another embodiment, the partial pressure of the hydrocarbon is 0.95 bar.

In one embodiment, the step of contacting a hydrocarbon, with polyoxometalate catalyst and a molecular oxygen is conducted under applied voltage in an electrochemical cell. In one embodiment, in a three-electrode cell, the voltage applied ranges between (−1.5V) and (1.5V) (vs. SSCE). In another embodiment, the voltage ranges between (−1.5V) and (−1.0V) (vs. SSCE). In another embodiment, the voltage is between (−1.0V) and (−0.5V) (vs. SSCE). In another embodiment, the voltage is between (−0.5) and (0) V (vs. SSCE). In another embodiment, the voltage is between (0) and (0.5) V (vs. SSCE). In another embodiment, the voltage is between (0.5) and (1.0) V (vs. SSCE). In another embodiment, the voltage is between (1.0V) and (1.5V) (vs. SSCE). In another embodiment, the voltage is 0 V (vs. SSCE).

In one embodiment, in a two-electrode cell, the cell comprises a cathode and an anode and the cell voltage applied is 1.80V. In one embodiment, the voltage applied to the electrodes of the two-electrode cell ranges between 0V and 2V, between 1V and 2V between 0.5V and 2.5V or between 0.1V and 3V.

In one embodiment, the electrochemical cell of this invention comprises working (cathode) and counter (anode) electrodes. In one embodiment, the electrochemical cell of this invention comprises working, counter and reference electrodes. In one embodiment, any material and shape of electrode as known in the art can be used in this invention. In another embodiment, non-limiting examples of working (cathode) electrode materials include carbon-based materials including carbon nitrides, glassy carbon, graphite, carbon fibers, or platinum. Each material represents a separate embodiment of the invention. In another embodiment the counter (anode) electrode is platinum or an electrode containing cobalt, manganese, iron, nickel, ruthenium or iridium oxides known to oxidize water to oxygen and protons and electrons. Each material and combinations thereof represent a separate embodiment of the invention. In another embodiment, non-limiting examples of reference electrodes include silver/silver chloride electrode (SSCE), a silver/silver nitrate electrode, a ferrocene/ferrocenium electrode or a saturated calomel electrode (SCE). Each electrode represents a separate embodiment of the invention. In another embodiment, non-limiting examples anode or cathode electrode shapes include discs, cylinders, plates, porous solids, nets, wires, mesh, cloths, or fibers. Each shape or geometry represents a separate embodiment of the invention. In another embodiment, the following setup is utilized: SSCE as reference electrode, a platinum net as working electrode and a platinum wire as counter electrode. In another embodiment, the following setup is utilized: platinum mesh cathode or a carbon fiber cathode and a platinum wire anode.

In one embodiment, the electrochemical cell of this invention comprises a cathode and anode, and a catalyst. In one embodiment, the catalyst of this invention is used in solid form. In one embodiment, the catalyst of this invention is dissolved in solution. In one embodiment, the solution comprises a solvent and a solute, the solute being the catalyst of this invention. In one embodiment, the solvent is water and the solute is the catalyst of this invention. In one embodiment, the concentration of the solution ranges between 0.1-5 mM. In one embodiment, the concentration of the solution ranges between 0.1-10 wt %/vol.

In one embodiment, the electrolyte further comprises additives, stabilizers, salts, ions, or a combination thereof. In one embodiment, the pH of the electrolyte is adjusted. In one embodiment, the pH of the solution comprising water and the catalyst ranges between 0-14. In other embodiment, the concentration of (OFF) or ($H^f$) in the solution corresponds to a value that is beyond the 0-14 pH range. In one embodiment, the pH value of the solution is acidic. In one embodiment, the pH of the solution is basic. In one embodiment, the solution pH ranges between 6-8, between 5-9, between 4-10, 3-11, 2-12 or 1-13.

In one embodiment, the method of this invention comprises reacting a polyoxometalate of this invention and a hydrocarbon in an electrochemical cell in a batch reaction. In one embodiment, the method of this invention comprises reacting a polyoxometalate of this invention and a hydrocarbon in an electrochemical cell in a batch reactor. In one embodiment, the method of this invention comprises reacting a polyoxometalate of this invention and a hydrocarbon in an electrochemical cell in a continuous flow reaction. In another embodiment, the reaction is conducted in a continuous flow reactor.

In one embodiment, the method of this invention comprises reacting a polyoxometalate of this invention and a hydrocarbon in an electrochemical cell for a period of between 0.1-72 hours. In another embodiment, for 0.1-2 hours. In another embodiment, for 2-5 hours. In another embodiment, for 5-10 hours. In another embodiment, for 10-15 hours. In another embodiment, for 10-20 hours. In another embodiment, for 15-30 hours. In another embodiment, the step is conducted for 20-50 hours. In another embodiment, for 25-72 hours. In another embodiment, for 24 hours.

Definitions

The term "light hydrocarbon" refers to any hydrocarbon that has between 1-6 carbon atoms.

The term "oxygenation" refers to an oxidation reaction wherein at least one oxygen atom is inserted into the molecule to be oxidized during the reaction.

The term "room temperature" refers to a temperature of between 15-30° C. In another embodiment, room temperature refers to a temperature between 15-20° C. In another embodiment, room temperature refers to a temperature between 20-25° C. In another embodiment, room temperature refers to a temperature between 25-30° C.

The term "oxyanion" refers to an anion comprising at least one oxygen atom and one other element.

The term "carbon-carbon bond cleavage products" refers to products that were obtained upon cleavage or breaking of a carbon-carbon bond within a hydrocarbon used in this invention. Non-limiting examples of carbon-carbon bond cleavage products include aldehyde and/or hydrate thereof, ketone, carboxylic acid and any combination thereof.

The term "carbon-hydrogen bond oxygenation products" refers to products that were obtained upon (at least one) insertion of (at least one) oxygen atom into a carbon-hydrogen bond within a hydrocarbon used in this invention. Non-limiting examples of carbon-hydrogen oxygenation products include α-hydroxy carboxylic acid, diol, α-hydroxy aldehyde and/or hydrate thereof, alcohol, aldehyde, ketone, carboxylic acid and any combination thereof.

The term "redox active" refers to a species that is oxidized or reduced by applying voltage or by reacting with a reductant or oxidant.

The following examples are presented in order to more fully illustrate the preferred embodiments of the invention. They should in no way, however, be construed as limiting the broad scope of the invention.

EXAMPLES

Example 1

Preparation of $\{Fe^{III}_{30}W^{VI}_{72}\}$ $Na_6(NH_4)_{20}(Fe^{III}(H_2O)_6)_2[\{(W^{VI})W^{VI}_5O_{21}(SO_4)\}_{12}\{(Fe(H_2O))_{30}\}(SO_4)_{13}(H_2O)_{34}]\cdot 200\ H_2O(\{Fe^{III}_{30}W^{VI}_{72}\})$ prepared according the procedure disclosed in Todea et al.

(Todea, A. M.; Merca, A.; Bögge, H.; Glaser, T.; Pigga, J. M.; Langston, M. L. K.; Liu, T.; Prozorov, R.; Luban, M.; Schröder, C.; Casey, W. H.; Müller, A. Porous capsules $\{(M)M_5\}_{12}Fe^{III}_{30}$(M=$Mo^{VI}$, $W^{VI}$): Sphere surface supramolecular chemistry with 20 ammonium ions, related solution properties, and tuning of magnetic exchange interactions. *Angew. Chem. Int. Ed.* 49, 514-519 (2010)). Briefly, $FeSO_4 \cdot 7H_2O$ (3.5 g, 12.6 mmol) was added to a solution of $Na_2WO_4 \cdot 2H_2O$ (4.0 g, 12.1 mmol) in $H_2O$ (25 mL) and acidified with $H_2SO_4$ (0.5 m; 20 mL). The solution stirred for 8 h in an oil bath at 100° C. and subsequently $NH_4Cl$ (1.25 g, 23.37 mmol) was added to the orange-yellow solution. The mixture was then cooled to room temperature and filtered. The yellow crystals, which precipitated after three weeks, were filtered off, washed with cold water, and dried in air. The resulting $\{Fe^{III}_{30}\ W^{VI}_{72}\}$ polyoxometalate was characterized as described by Todea et al.

Example 2

Ethylene Oxygenation Using a Method of this Invention

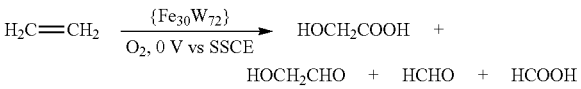

$\{Fe^{III}_{30}\ W^{VI}_{72}\}$ (50 mg) was dissolved in 2.5 mL water in an electrochemical cell consisting of a Ag/AgCl reference electrode, a platinum net as working electrode and a platinum wire counter electrode. At room temperature the cell was pressurized at 1 bar of a gaseous mixture containing 5% $O_2$ and 95% ethylene. 0 V versus SSCE was applied to the electrochemical cell for 24 h and the products were analyzed by $^1H$ NMR. 2-hydroxyacetic acid (1.2 μmol), glycolic aldehyde, present as hydrate, (1.3 μmol), formic acid (3.6 μmol) and formaldehyde, present as hydrate, (7.9 μmol) were formed. The faradaic efficiency was 20.3%.

Example 3

Propylene Oxygenation Using a Method of this Invention

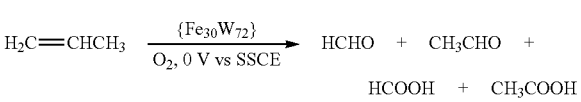

$\{Fe^{III}_{30}W^{VI}_{72}\}$ (50 mg) was dissolved in 2.5 mL water in an electrochemical cell consisting of a Ag/AgCl reference electrode, a platinum net as working electrode and a platinum wire counter electrode. At room temperature the cell was pressurized at 1 bar of a gaseous mixture containing 5% $O_2$ and 95% propylene. 0 V versus SSCE was applied to the electrochemical cell for 24 h and the products were analyzed by $^1H$ NMR. Acetic acid (10.3 μmol), acetaldehyde, (3.1 μmol), formic acid (5.3 μmol) and formaldehyde, present as hydrate, (11.8 μmol) were formed. The faradaic efficiency was 33.7%.

Example 4

Ethane Oxygenation Using the Method of this Invention

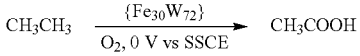

$\{Fe^{III}_{30}W^{VI}_{72}\}$ (50 mg) was dissolved in 2.5 mL water in an electrochemical cell consisting of a Ag/AgCl reference electrode, a platinum net as working electrode and a platinum wire counter electrode. At room temperature the cell was pressurized at 1 bar of a gaseous mixture containing 5% $O_2$ and 95% ethane. 0 V versus SSCE was applied to the electrochemical cell for 24 h and the products were analyzed by $^1H$ NMR. Acetic acid (6.9 μmol), and formic acid (0.2 μmol) were formed. The faradaic efficiency was 13.3%.

Examples 5-8

Additional Ethane Oxygenation Reactions Using the Method of this Invention

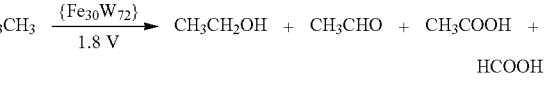

50 mg $\{Fe^{III}_{30}W^{VI}_{72}\}$ was dissolved in 2.5 mL $H_2O$ in an electrochemical cell consisting of a platinum mesh cathode or a carbon fiber cathode and a platinum wire anode. Reactions were run for 24 h at a potential of 1.8 V. Products were quantified by $^1H$ NMR. The reactions are summarized in the Table.

| | Reaction Conditions | | | |
|---|---|---|---|---|
| Product, μmol | Example 5<br>T = 20° C.<br>$P_{air}$ = 0. 25 bar<br>$P_{ethane}$ = 0.75 bar<br>Pt mesh cathode | Example 6<br>T= 5° C.<br>$P_{air}$ = 0.25 bar<br>$P_{ethane}$ = 0.75 bar<br>Pt mesh cathode | Example 7<br>T = 20° C.<br>$P_{air}$ = 1 bar<br>$P_{ethane}$ = 2 bar<br>Pt mesh cathode | Example 8<br>T = 20° C.<br>$P_{air}$ = 1 bar<br>$P_{ethane}$ = 2 bar<br>Carbon fiber cathode |
| acetic acid | 5.9 | 8.3 | 10.0 | 17.9 |
| formic acid | 0.3 | 0.6 | 0.4 | 1.8 |
| acetaldehyde | — | 0.4 | 2.0 | 4.7 |
| ethanol | — | 0.1 | 0.3 | 0.2 |

-continued

| Product, μmol | Reaction Conditions | | | |
|---|---|---|---|---|
| | Example 5<br>T = 20° C.<br>$P_{air}$ = 0. 25 bar<br>$P_{ethane}$ = 0.75 bar<br>Pt mesh cathode | Example 6<br>T= 5° C.<br>$P_{air}$ = 0.25 bar<br>$P_{ethane}$ = 0.75 bar<br>Pt mesh cathode | Example 7<br>T = 20° C.<br>$P_{air}$ = 1 bar<br>$P_{ethane}$ = 2 bar<br>Pt mesh cathode | Example 8<br>T = 20° C.<br>$P_{air}$ = 1 bar<br>$P_{ethane}$ = 2 bar<br>Carbon fiber cathode |
| Faradaic efficiency | 11.5% | 15.0% | 23.6% | 62.5% |

Example 9

Propane Oxygenation Using the Method of this Invention

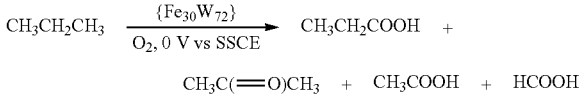

$\{Fe^{III}_{30}W^{VI}_{72}\}$ (50 mg) was dissolved in 2.5 mL water in an electrochemical cell consisting of a Ag/AgCl reference electrode, a platinum net as working electrode and a platinum wire counter electrode. At room temperature the cell was pressurized at 1 bar of a gaseous mixture containing 5% $O_2$ and 95% propane. 0 V versus SSCE was applied to the electrochemical cell for 24 h and the products were analyzed by $^1$H NMR. Acetic acid (2.5 μmol), formic acid (0.7 μmol), formaldehyde as hydrate (0.3 μmol), acetone (1.6 μmol) and propionic acid (2.1 μmol) were formed. The faradaic efficiency was 12.5%.

Example 10

Propane Oxygenation Using the Method of this Invention (T=5° C.)

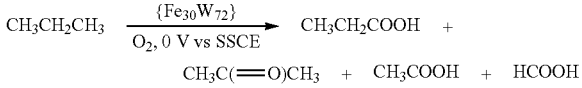

$\{Fe^{III}_{30}W^{VI}_{72}\}$ (50 mg) was dissolved in 2.5 mL water in an electrochemical cell consisting of a Ag/AgCl reference electrode, a platinum net as working electrode and a platinum wire counter electrode. At 5° C. the cell was pressurized at 1 bar of a gaseous mixture containing 5% $O_2$ and 95% propane. 0 V versus SSCE was applied to the electrochemical cell for 24 h and the products were analyzed by $^1$H NMR. Acetic acid (1.3 μmol), formic acid (0.7 μmol), acetone (4.1 μmol) and propanoic acid (2.0 μmol) were formed. The faradaic efficiency was 25.3%.

Example 11

Methane Oxygenation Using the Method of this Invention

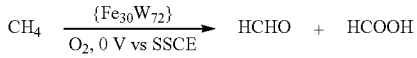

$\{Fe^{III}_{30}W^{VI}_{72}\}$ (50 mg) was dissolved in 2.5 mL water in an electrochemical cell consisting of a Ag/AgCl reference electrode, a platinum net as working electrode and a platinum wire counter electrode. At room temperature the cell was pressurized at 1 bar of a gaseous mixture containing 5% $O_2$ and 95% methane. 0 V versus SSCE was applied to the electrochemical cell for 24 h and the products were analyzed by $^1$H NMR. Formic acid (0.1 μmol), and formaldehyde as hydrate (0.1 μmol) were formed. The faradaic efficiency was 0.8%.

Example 12

Isobutane Oxygenation Using the Method of this Invention

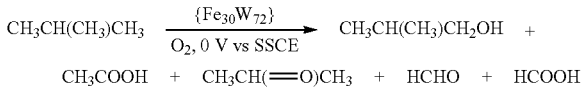

$\{Fe^{III}_{30}W^{VI}_{72}\}$ (50 mg) was dissolved in 2.5 mL water in an electrochemical cell consisting of a Ag/AgCl reference electrode, a platinum net as working electrode and a platinum wire counter electrode. At room temperature the cell was pressurized at 1 bar of a gaseous mixture containing 5% $O_2$ and 95 isobutane. 0 V versus SSCE was applied to the electrochemical cell for 24 h and the products were analyzed by $^1$H NMR. Tert-butanol (1.1 μmol), formaldehyde as hydrate (0.8 μmol), acetic acid (0.5 μmol), formic acid (0.3 μmol) and acetone (0.2 μmol) were formed. The faradaic efficiency was 16.6%.

Example 13

Benzene Oxygenation Using the Method of this Invention

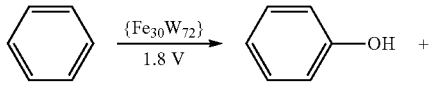

-continued

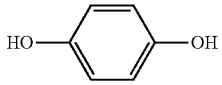

$\{Fe^{III}_{30}W^{VI}_{72}\}$ (50 mg) and benzene (330 μmol) were mixed in 2.5 mL water under 1 bar air in an electrochemical cell consisting a platinum net cathode and a platinum anode. After 24 h at 1.8 V the products were analyzed by $^1$H NMR. Phenol (7.6 μmol), and hydroquinone (5.5 μmol) were the major (>95%) products formed. The faradaic efficiency was 18.0%.

Example 14

Maleic Acid Oxygenation Using the Method of this Invention $$\text{cis-HOOCCH}{=}\text{CHCOOH} \xrightarrow[1.8\ V]{\{Fe_{30}W_{72}\}} \text{HOOCCHO} + \text{HCOOH}$$

$\{Fe^{III}_{30}W^{VI}_{72}\}$ (50 mg) and maleic acid (105 μmol) were mixed in 2.5 mL water under 1 bar air in an electrochemical cell consisting a platinum net as working electrode and a platinum wire counter electrode. After 24 h at 1.8 V the products were analyzed by $^1$H NMR. Glyoxylic acid (4.2 μmol) and formic acid (1.8 μmol) were formed. The faradaic efficiency was 10.4%.

Example 15

Ethane Oxygenation Using $\{Fe^{III}_{30}Mo^{VI}_{72}\}$ as Catalyst in the Method of this Invention $$CH_3CH_3 \xrightarrow[1.8\ V]{\{Fe_{30}Mo_{72}\}} CH_3COOH + HCOOH$$

$\{Fe^{III}_{30}Mo^{VI}_{72}\}$ (50 mg, prepared according to Muller. A. et. al; Angew. Chem. Int. Ed. 1999, 38, 3238-3241) was dissolved in 2.5 mL water in an electrochemical cell consisting of a platinum net as working electrode and a platinum wire counter electrode. At room temperature the cell was pressurized at 1 bar of air and 2 bar of ethane. 1.8 V was applied to the electrochemical cell for 24 h and the products were analyzed by $^1$H NMR. Acetic acid (1.9 μmol, and formic acid (0.6 μmol) were formed. The faradaic efficiency was 8.1%.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A method for the preparation of oxygenated hydrocarbon products from a hydrocarbon, the method comprising a step of contacting a hydrocarbon with molecular oxygen and with a polyoxometalate catalyst of formula (1):

$Q_i[\{(M)M_5O_{21}(X')_o\}_j\{(M'(H_2O))_k\}(X)_l(H_2O)_m]$ or a solvate thereof;

wherein:

i is between 0-50;

j is between 5-20;

k is between 0-50;

l is between 5-50;

m is between 0-50;

o is between 0-10;

each of Q is independently absent or the same or different metal cation or $NH_4^+$ or solvate thereof;

each of X is independently $H_2O$ or the same or different anion;

each of X' is independently $H_2O$ or the same or a different anion;

each of M is independently Mo and W; and each of M' is independently Fe, V, Cr, Mn, Co, Ni or Cu;

wherein said contacting step is conducted in an electrochemical cell, said electrochemical cell comprises a cathode, an anode and a catalyst and wherein voltage is applied to said cell, thereby generating the oxygenated hydrocarbon products.

2. The method of claim 1, wherein each of Q is independently selected from an alkali metal cation, an alkaline earth metal cation, a transition metal cation, a lanthanide metal cation and $NH_4^+$, or a solvate thereof.

3. The method of claim 1, wherein at least one of said Q is $NH_4^+$.

4. The method of claim 1, wherein at least one of said Q is a metal cation; and wherein said metal cation is alkali metal cation or alkaline earth metal cation.

5. The method of claim 4, wherein said alkali metal cation comprises Li, Na, K, Rb or Cs.

6. The method of claim 4, wherein said alkaline earth metal cation comprises Be, Mg, Ca, Sr, Ba or Ra.

7. The method of claim 1, wherein at least one of said Q is a metal cation; and wherein said metal cation is a transition metal cation.

8. The method of claim 7, wherein said transition metal cation comprises V, Cr, Mn, Fe or Cu.

9. The method of claim 1, wherein said $Q_i$ is a combination of $Na^+$, $NH_4^+$ and $Fe^{2+}$ or $Fe^{3+}$, or a solvate thereof.

10. The method of claim 1, wherein said $Q_i$ is $Q_{28}$ or i=0 and Q is absent.

11. The method of claim 10, wherein said $Q_{28}$ is $\{Na_6(NH_4)_{20}(Fe^{III}(H_2O)_6)_2\}^{32+}$.

12. The method of claim 1, wherein each of said X or X' is independently selected from $H_2O$, sulfate ($SO_4^{2-}$), bisulfate ($HSO_4^-$), methanesulfonate ($CH_3SO_3^-$), triflate ($CF_3SO_3^-$), benzenesulfonate, ($C_6H_5SO_3^-$), formate ($HCOO^-$), phosphate ($PO_4^{3-}/HPO_4^{2-}/H_2PO_4^-$), acetate ($CH_3COO^-$) and trifluoroacetate ($CF_3COO^-$).

13. The method of claim 12, wherein at least one of said X and X' is sulfate ($SO_4$—) or bisulfate ($HSO_4^-$).

14. The method of claim 1, wherein said molecular oxygen is a gas composition comprising $O_2$, or pure $O_2$.

15. The method of claim 1, wherein said gas composition comprising $O_2$ comprises air, diluted air, concentrated air, a mixture of $O_2$ and inert gas, a mixture of $O_2$ and said hydrocarbon or any mixture thereof.

16. The method of claim 1, wherein the partial pressure of said $O_2$ is between 0.01-100 bar and the partial pressure of said hydrocarbon is between 0.01-100 bar.

17. The method of claim 1, wherein said polyoxometalate is a polyoxometalate of formula (2): $Q_i[\{(M)M_5O_{21}(X')_O\}_j\{(M(H_2O))_k\}(X)_l(H_2O)_m].nH_2O$ (2); wherein n is between 0-1000.

18. The method of claim 17, wherein said polyoxometalate is a polyoxometalate of formula (3): $Q_i[\{(W^{VI})W^{VI}_5O_{21}(X')_o\}_j\{(Fe(H_2O))_k\}(X)_l(H_2O)_m].nH_2O$ (3).

19. The method of claim 17, wherein said polyoxometalate is a polyoxometalate of formula (4):

$$Na_6(NH_4)_{20}(Fe^{III}(H_2O)_6)_2[\{(W^{VI})W^{VI}_5O_{21}(SO_4)\}_{12}\{(Fe(H_2O))_{30}\}(SO_4)_{13}(H_2O)_{34}].nH_2O \quad (4).$$

20. The method of claim 17, wherein said polyoxometalate is a polyoxometalate of formula (6): $[\{(Mo^{VI})Mo^{VI}_5O_{21})(X'_1)_6\}_{12}\{Fe^{III}(H_2O)(X_1)\}_{30}].nH_2O$, (6), wherein $X'_1$ and $X_1$ are each independently selected from $H_2O$, $Mo_2O_8^{2-}$, $Mo_2O_9^{2-}$ and $CH_3COO^-$ (acetate); said polyoxometalate of formula (6) comprises 12 $CH_3COO^-$ (acetate) anions and 3 (three) dimolybdate anions; and each dimolybdate anion is $Mo_2O_8^{2-}$ or $Mo_2O_9^{2-}$ anion.

21. The method of claim 1, wherein said polyoxometalate is dissolved in a solvent to form a solvate thereof.

22. The method of claim 21, wherein said solvent is selected from water, sulfolane, acetone, acetic acid, acetonitrile or any combination thereof.

23. The method of claim 1, wherein said polyoxometalate is not dissolved in a solvent.

24. The method of claim 1, wherein said hydrocarbon comprises substituted or unsubstituted $C_1$-$C_{10}$ alkenes, $C_1$-$C_{10}$ alkanes, arenes or any combination thereof.

25. The method of claim 24, wherein said alkane comprises methane, ethane, propane or isobutane.

26. The method of claim 24, wherein said alkene comprises ethylene, maleic acid or propylene.

27. The method of claim 24, wherein said arene is benzene.

28. The method of claim 1, wherein said oxygenated hydrocarbon products comprise carbon-carbon bond cleavage products, carbon-hydrogen oxygenation products, carbon-carbon bond addition products, epoxides or any combination thereof.

29. The method of claim 28, wherein said carbon-carbon bond cleavage products comprise aldehyde and/or hydrate thereof, ketone, α-oxo carboxylic acid or carboxylic acid.

30. The method of claim 29, wherein said aldehyde is formaldehyde or acetaldehyde; said ketone is acetone; said, α-oxo carboxylic acid is glyoxylic acid; and said carboxylic acid is formic acid or acetic acid.

31. The method of claim 28, wherein said carbon-hydrogen bond oxygenation products are selected from α-hydroxy carboxylic acid, α-hydroxy aldehyde, and/or hydrate thereof, alcohol, aldehyde, ketone, epoxide, diol, hydroxyarene, dihydroxyarene and carboxylic acid.

32. The method of claim 31, wherein said α-hydroxy carboxylic acid is 2-hydroxyacetic acid; said α-hydroxy aldehyde is glycolic aldehyde and/or hydrate thereof; said carboxylic acid is formic acid, acetic acid or propionic acid; said ketone is acetone; propionic acid, said aldehyde is formaldehyde; said hydroxyarene is phenol; said dihydroxyarene is hydroquinone; and said alcohol is tert-butanol or ethanol.

33. The method of claim 28, wherein said hydrocarbon is ethane and said carbon-hydrogen oxygenation product is acetic acid.

34. The method of claim 28, wherein said hydrocarbon is benzene and said carbon-hydrogen oxygenation products are phenol and hydroquinone.

35. The method of claim 1, wherein said step is conducted at a temperature of between 2 and 100° C.

36. The method of claim 35 wherein said temperature is 5° C.

37. The method of claim 35 wherein said temperature is room temperature.

38. The method of claim 1, wherein voltage application in said electrochemical cell is between (−1.5V)−(1.5 V) (vs. SSCE).

39. The method of claim 38, wherein said applied voltage is 0 V (vs. SSCE).

40. The method of claim 1, wherein the cathode of the electrochemical cell is a platinum mesh cathode or a carbon fiber cathode and the anode is a platinum wire anode.

41. The method of claim 1, wherein the reaction is conducted in a continuous flow reactor.

* * * * *